US010595571B2

(12) United States Patent
Lai

(10) Patent No.: US 10,595,571 B2
(45) Date of Patent: Mar. 24, 2020

(54) DOUBLE BREASTED RAINCOAT

(71) Applicant: Tien-Te Lai, Hsinchu (TW)

(72) Inventor: Tien-Te Lai, Hsinchu (TW)

( * ) Notice: Subject to any disclaimer, the term of this patent is extended or adjusted under 35 U.S.C. 154(b) by 75 days.

(21) Appl. No.: 15/970,974

(22) Filed: May 4, 2018

(65) Prior Publication Data

US 2018/0325190 A1 Nov. 15, 2018

(30) Foreign Application Priority Data

May 11, 2017 (TW) ..... 106115584 A

(51) Int. Cl.

| | |
|---|---|
| ***A41D 3/04*** | (2006.01) |
| ***A41D 27/24*** | (2006.01) |
| ***A41D 27/18*** | (2006.01) |
| ***A41D 27/04*** | (2006.01) |

(52) U.S. Cl.

CPC ..... *A41D 3/04* (2013.01); *A41D 27/04* (2013.01); *A41D 27/18* (2013.01); *A41D 27/24* (2013.01); *A41D 2300/30* (2013.01); *A41D 2300/50* (2013.01)

(58) Field of Classification Search

CPC ..... A41D 27/02; A41D 27/04; A41D 27/18; A41D 2300/30; A41D 2300/50; A41D 3/04; A41B 1/18; A41B 1/22

USPC ..... 2/87, 96

See application file for complete search history.

(56) References Cited

U.S. PATENT DOCUMENTS

| | | | | | |
|---|---|---|---|---|---|
| 1,100,871 | A * | 6/1914 | Goldman | A41D 3/04 | 2/87 |
| 1,335,505 | A * | 3/1920 | Huntington | A41D 27/18 | 2/87 |
| 1,549,359 | A * | 8/1925 | Hanson | A41D 27/02 | 2/85 |
| 1,895,237 | A * | 1/1933 | Staw | A41D 1/02 | 2/93 |

* cited by examiner

*Primary Examiner* — Katherine M Moran

(74) *Attorney, Agent, or Firm* — Alan D. Kamrath; Karin L. Williams; Mayer & Williams PC

(57) ABSTRACT

A double breasted raincoat has a body, two sleeves, a first collar, two cover sheets, a second collar, and at least one mounting element. The body has a top portion, a left portion, a right portion, a back sheet, a left front sheet, a right front sheet, a neckline, and two cuffs. The neckline is formed thorough the top portion of the body. The two cuffs are respectively formed through the left portion and the right portion of the body. The two sleeves are respectively connected with edges of the two cuffs. The first collar is connected with an edge of the neckline. The second collar is mounted on an inner surface of the first collar. The at least one mounting element is mounted on a right side edge of the left cover sheet and a left side edge of the right cover sheet.

12 Claims, 12 Drawing Sheets

DOUBLE BREASTED RAINCOAT

BACKGROUND OF THE INVENTION

1. Field of the Invention

The present invention relates to a raincoat, more particularly to a double breasted raincoat that has an improved water proof effect.

2. Description of Related Art

With reference to FIG. 12, a conventional double breasted raincoat has a body 1, two sleeves 6, and a first collar 7. The body 1 has a top portion, a left portion, a right portion, a back sheet 2, a left front sheet 3, a right front sheet 4, a neckline 9, and two cuffs 6-1. The neckline 9 is formed thorough the top portion of the body 1. The two cuffs 6-1 are respectively formed through the left portion and the right portion of the body 1. The left front sheet 3 and the right front sheet 4 overlap with each other, and the overlap region has multiple buttons 5 and button holes 5-1. The two sleeves 6 are respectively connected with edges of the two cuffs 6-1. The first collar 7 is connected with an edge of the neckline 9.

The conventional double-breasted raincoat looks graceful in appearance and can shelter from wind and rain, but few motorcycle riders wear conventional double-breasted raincoat on raining days for two reasons as follows.

Since only the outer edges of the left front sheet 3 and the right front sheet 4 are overlapped and the buttons 5 and the button holes 5-1 are fixed at the overlapping portions, a gap between the left front sheet 3 and the right front sheet 4 is too large. Thus, the rainwater would directly permeate into the conventional double breasted raincoat.

Because the first collar 7 is a suit-style collar, the first collar 7 must be erected first to overlap a front collar. The wind pressure can cause the rainwater to permeate into the raincoat directly from the neck.

SUMMARY OF THE INVENTION

The main objective of the present invention is to provide a double breasted raincoat that improves the water proof effect.

The double breasted raincoat has a body, two sleeves, a first collar, two cover sheets, a second collar, and at least one mounting element. The body has a top portion, a left portion, a right portion, a back sheet, a left front sheet, a right front sheet, a neckline, and two cuffs. The neckline is formed thorough the top portion of the body. The two cuffs are respectively formed through the left portion and the right portion of the body. The two sleeves are respectively connected with edges of the two cuffs. The first collar is connected with an edge of the neckline. The second collar is disposed on an inner surface of the first collar. The at least one mounting element is mounted on a right side edge of the left cover sheet and a left side edge of the right cover sheet.

Other objects, advantages, and novel features of the invention will become more apparent from the following detailed description when taken in conjunction with the accompanying drawings.

DETAILED DESCRIPTION OF PREFERRED EMBODIMENT

Figure 1:
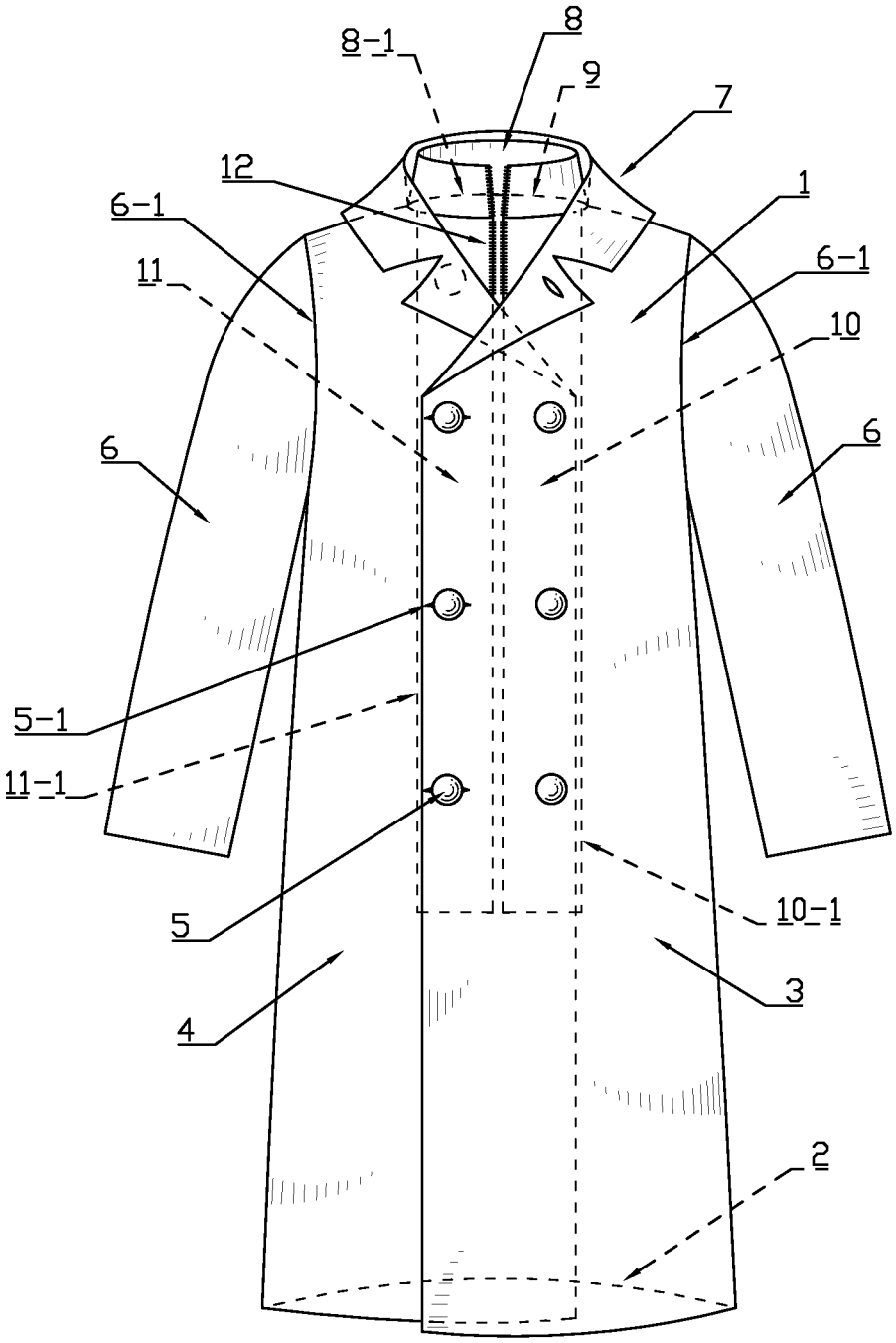
FIG. 1 is a front view of a first embodiment of a double breasted raincoat in accordance with the present invention.
Figure 2:
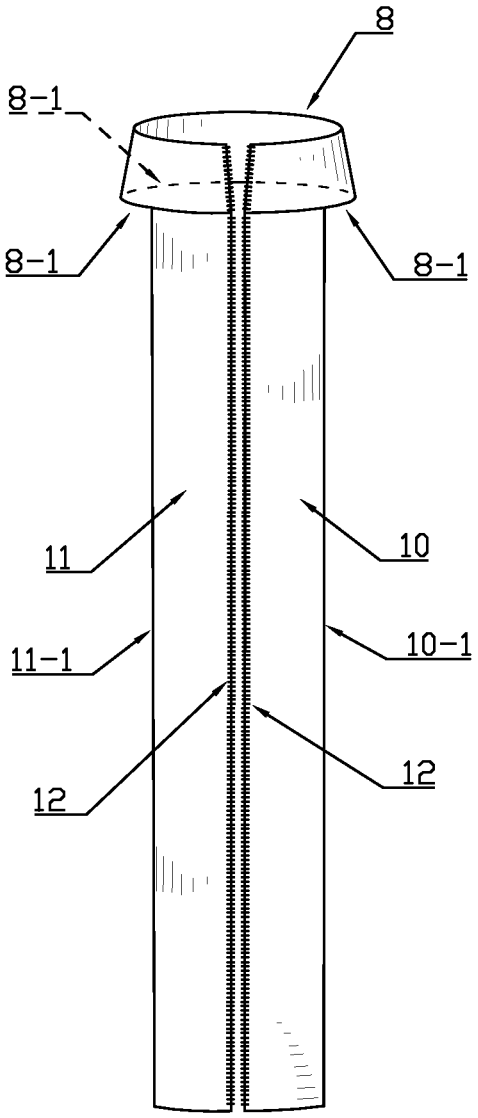
FIG. 2 is a front view of a waterproof shelter of the double breasted raincoat in FIG. 1.
Figure 3:
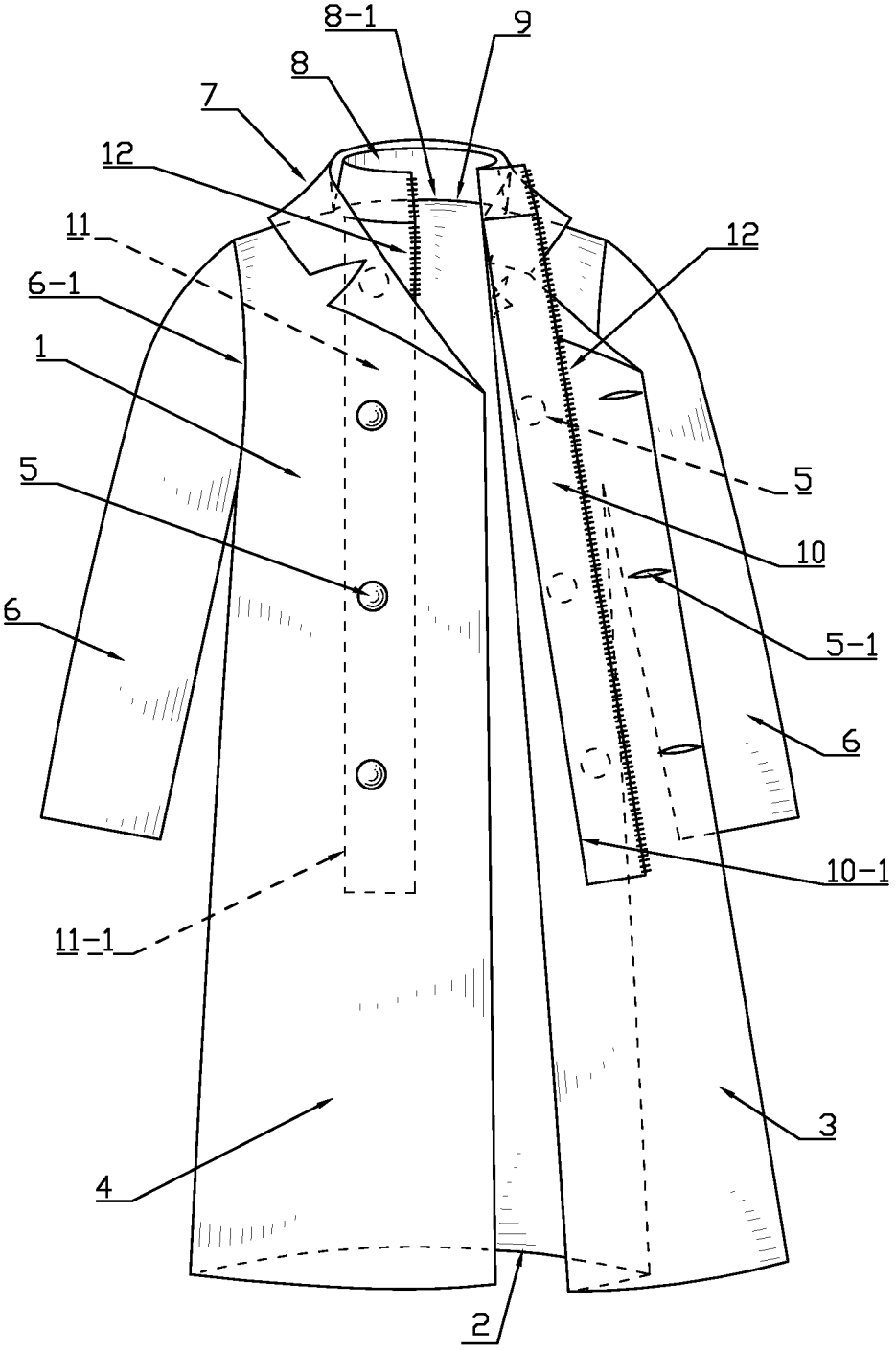
FIG. 3 is a perspective view of the double breasted raincoat in FIG. 1 showing that the left front sheet is open.

With reference to FIG. 1 to FIG. 3, a first preferred embodiment of a double breasted raincoat in accordance with the present invention includes a body 1, two sleeves 6, a first collar 7, two cover sheets, a second collar 8, and at least one mounting element 12.

The body 1 has a top portion, a left portion, a right portion, a back sheet 2, a left front sheet 3, a right front sheet 4, a neckline 9, and two cuffs 6-1. The neckline 9 is formed thorough the top portion of the body 1. The two cuffs 6-1 are respectively formed through the left portion and the right portion of the body 1. The left front sheet 3 and the right front sheet 4 overlap with each other, and the overlap region has multiple buttons 5 and button holes 5-1.

The two sleeves 6 are respectively connected with edges of the two cuffs 6-1.

The first collar 7 is connected with an edge of the neckline 9.

The two cover sheets include a left cover sheet 10 and a right cover sheet 11. The left cover sheet 10 is disposed on an inner surface of the left front sheet 3 and has a left side edge 10-1. The left side edge 10-1 is fixed on the inner surface of the left front sheet 3. The right cover sheet 11 is disposed on an inner surface of the right front sheet 4 and has a right side edge 11-1. The right side edge 11-1 is fixed on the inner surface of the right front sheet 4.

The second collar 8 is disposed on the inner surface of the first collar 7, that is, the first collar 7 is disposed around the second collar 8. A bottom left side edge of the second collar 8 is connected with an upper edge of the left cover sheet 10, and a bottom right side edge of the second collar 8 is connected with an upper edge of the right cover sheet 11. A lower edge 8-1 of the second collar 8 is connected with an opening edge of the neckline 9 of the body 1.

The at least one mounting element 12 is mounted on a right side edge of the left cover sheet 10 and a left side edge of the right cover sheet 11, and this makes the left cover sheet 10 and the right cover sheet 11 combined together. The mounting element 12 extends to a left side edge and a right side edge of the second collar 8, and this makes the left side edge and the right side edge of the second collar 8 combined together to improve the shelter effect to the neck of the user.

The mounting element 12 may be a zipper or a fastener tape or the like. In the present embodiment, the mounting element 12 is a zipper.

A sealing seam is formed between the lower edge 8-1 of the second collar 8 and the opening edge of the neckline 9. The sealing seam may extend to the left side edge 10-1 of the left cover sheet 10 and the right side edge 11-1 of the right cover sheet 11, and shelters the neck, the breast and the abdomen of the user from water, to form a waterproof shelter. When the mounting element 12 is buckled, the mounting element 12 can completely block the rainwater permeating from the first collar 7 or the gap that is overlapped by the left front sheet 3 and right front sheet 4 so that the rainwater cannot enter the raincoat, thereby enhancing the rainproof effect.

The left side edge 10-1 of the left cover sheet 10 may be attached to a piece of the left front sheet 3; the piece may be an inner lining or tarpaulins or folded cloth sheets or the like. In this way, the outer surface of the left front sheet 3 has no seams that may affect the appearance of the raincoat.

The right side edge 11-1 of the right cover sheet 11 may be attached to a piece of the right front sheet 4 (the piece may be an inner lining or tarpaulins or reversely folded cloth sheets or the like). In this way, the outer surface of the right front sheet 4 has no seams that may affect the appearance of the raincoat.

The left side of the left cover sheet 10 and the second collar 8 can be integrally formed depending on the design demand. The left cover sheet 10 can extend upward to form the left side of the second collar 8, and the right side of the right cover sheet 11 and the second collar 8 are formed. Alternatively, the right cover sheet 11 may extend upward to form the right side of the second collar 8.

Lengths of the left cover sheet 10 and the right cover sheet 11 may be modified based on design demands.

The double breasted raincoat of the invention may be designed according to the common designs of male and female outfits. For example, for males, the left front sheet 3 is located on the outer side and the right front sheet 4 is located on the inner side when the sheets are overlapped. For females, the right front sheet 4 is on the outer side, and the left front sheet 3 is on the inner side when overlapped.

Figure 4:
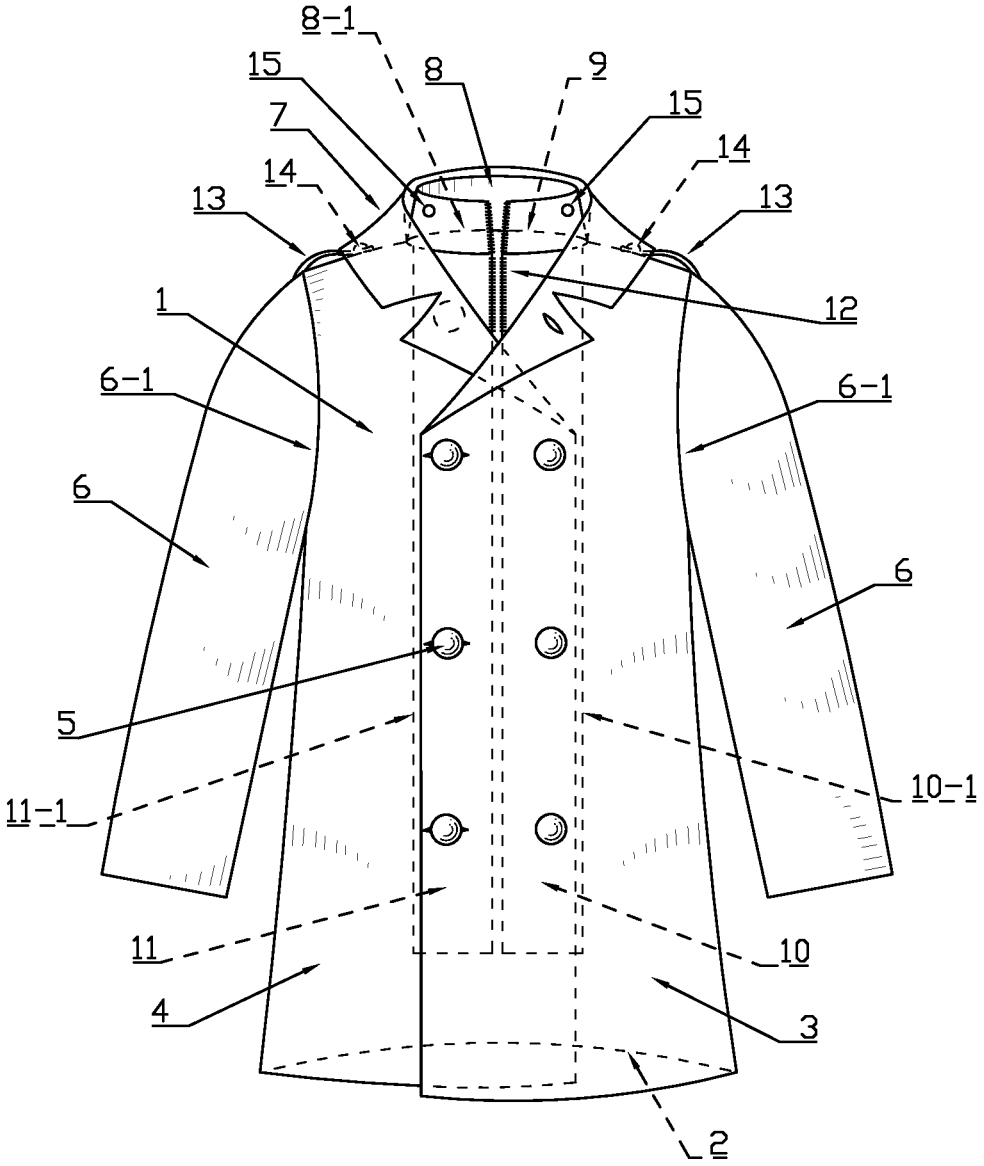
FIG. 4 is a front view of a second embodiment of a double breasted raincoat in accordance with the present invention.
Figure 5:
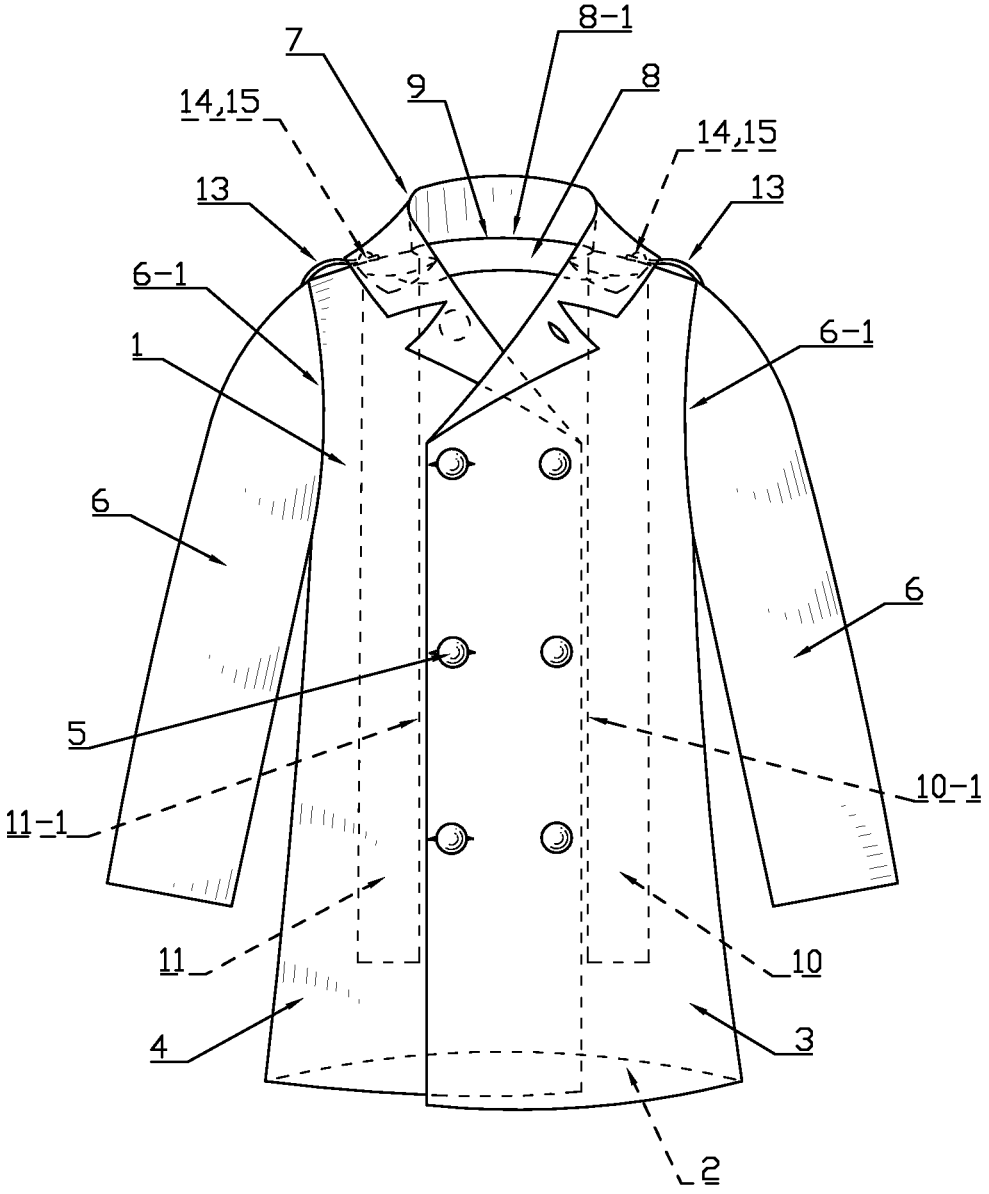
FIG. 5 is a front view of the double breasted raincoat mounted with fixing buckles in FIG. 4.
Figure 6:
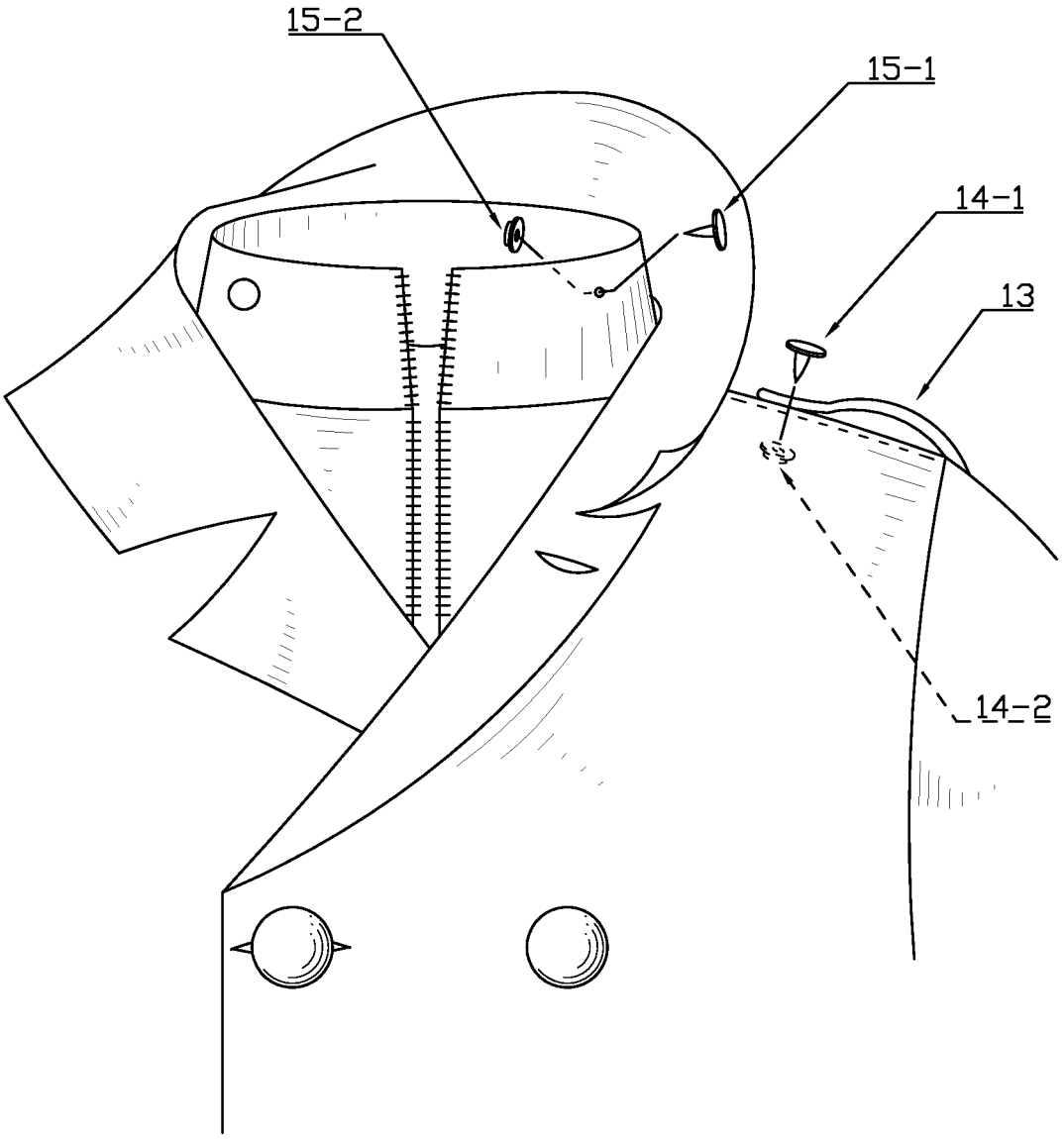
FIG. 6 is an enlarged operational perspective view of the double breasted raincoat in FIG. 4 showing that the inner section of the waterproof shelter is hidden.

With reference to FIG. 4 to FIG. 6, a second embodiment of a double breasted raincoat in accordance with the present invention is substantially the same as the first embodiment except for the following features. The length of the body 1 is shortened such that the raincoat is of a short coat type, which can be worn independently or with rain pants. The body 1 has a left shoulder, a right shoulder, a left shoulder strap 13, and a right shoulder strap 13. Outer side edges of the left and right shoulder straps 13 are respectively fixed on the two cuffs 6-1. Inner sides of the left and right shoulder straps 13 can be respectively fixed to the left and right shoulders of the body 1 with fixing buckles 14 (for example, a male stud). A left side and a right side of the second collar 8 each have a respective fixing buckle 15 (for example, a female stud). With reference to FIG. 6, the fixing buckle 14 is mounted through the left shoulder strap 13 by a pin 14-1 and is riveted with a male buckle 14-2. The fixing buckle 15 is mounted through the left side of the second collar 8 by a pin 15-1 and is riveted with a female buckle 15-2 which is located in the second collar 8. When the second collar 8, the left cover sheet 10 and right cover sheet 11 are folded inwards, the above-mentioned fixing buckle 14,15 can be fastened by snap-fastening. Therefore, the left and right shoulder straps 13 can be fixed at a specific position.

Figure 7:
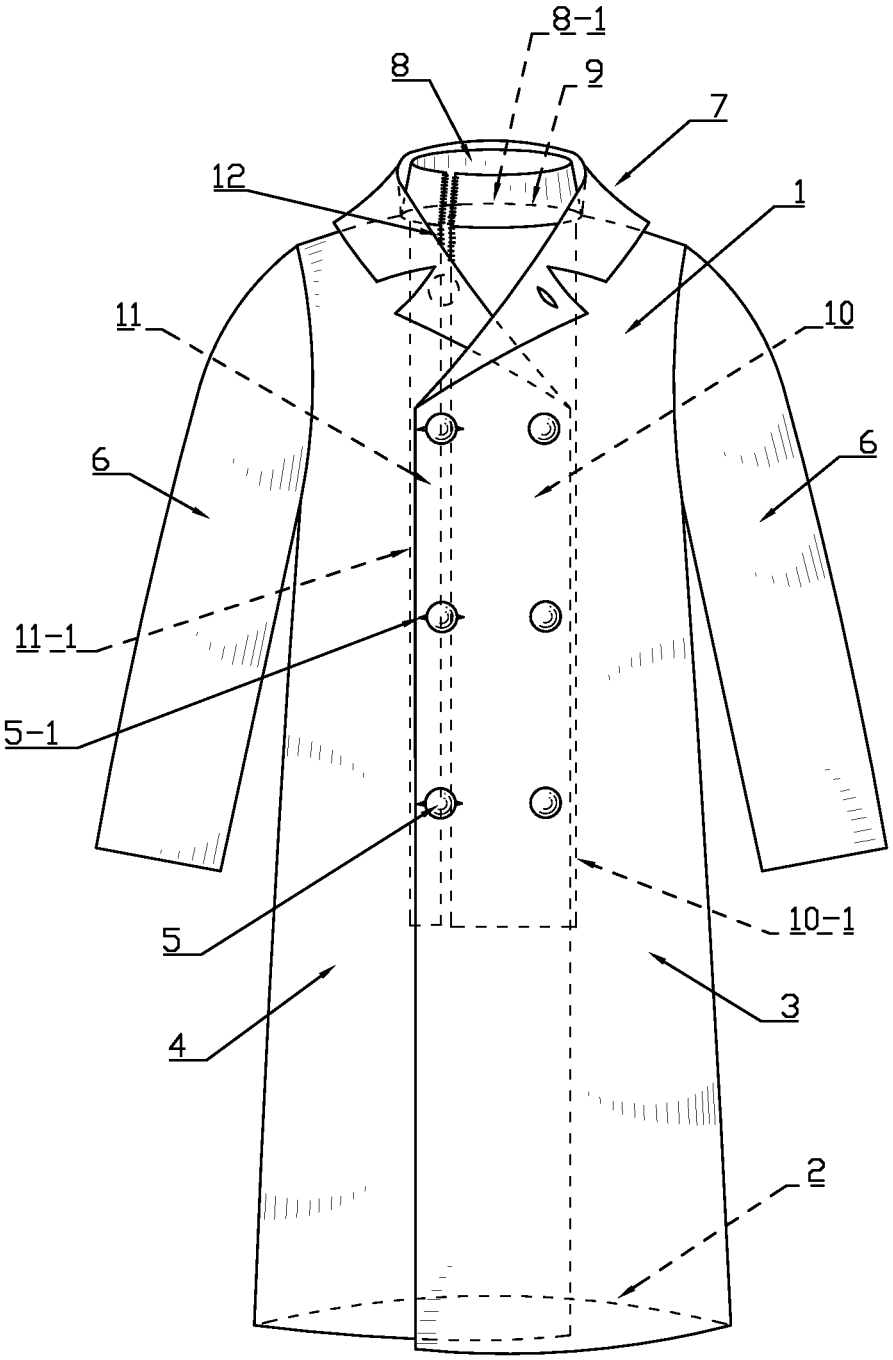
FIG. 7 is a front view of a third embodiment of a double breasted raincoat in accordance with the present invention.
Figure 8:
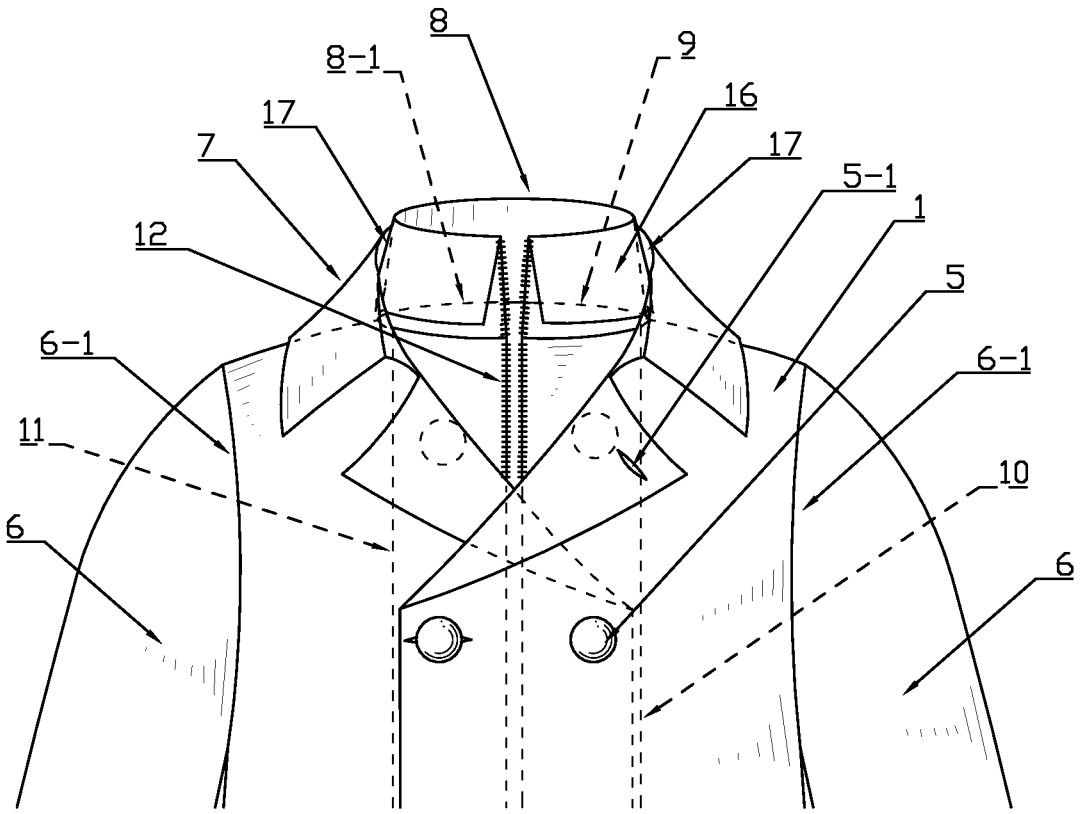
FIG. 8 is a front view of a fourth embodiment of a double breasted raincoat in accordance with the present invention.
Figure 9:
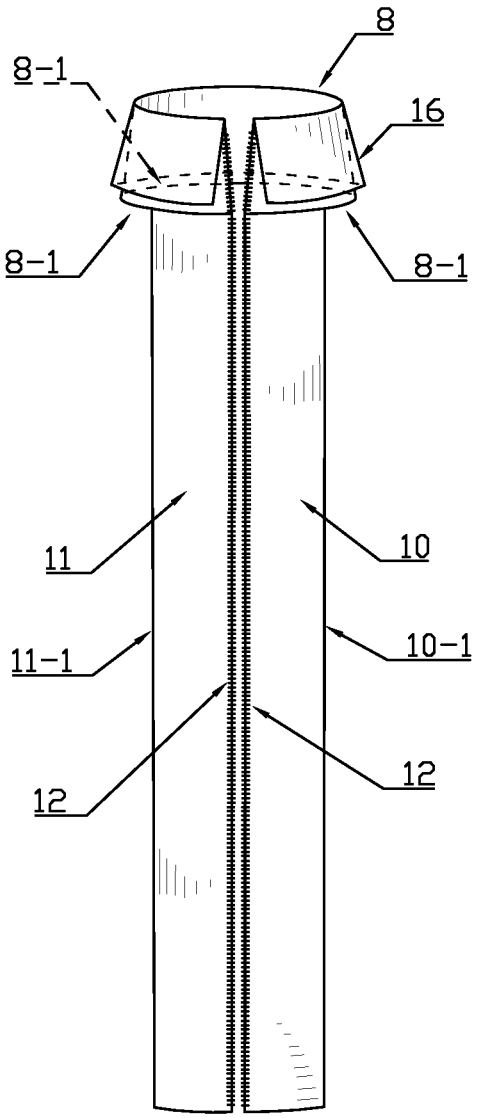
FIG. 9 is a front view of a waterproof shelter of the double breasted raincoat in FIG. 8.

With reference to FIG. 7, a third embodiment of a double breasted raincoat in accordance with the present invention is substantially the same as the first embodiment except for the following features. The widths of the left cover sheet 10 and the right cover sheet 11 may be different according to designs. The left cover sheet 10 in this embodiment is wider than the right cover sheet 11. The second collar 8 is also adjusted according to the widths of the left and right cover sheets 10, 11, and the mounting element 12 is also moved to the right side of the body 1. The present embodiment can extend the distance and time for the rainwater to permeate into the gap between the left and right front sheets 3, 4.

The width of the left cover sheet 10 and the width of the right cover sheet 11 may be the same or different according to design requirements. For example, the left cover sheet 10 is wider than the right cover sheet 11 (as shown in FIG. 7). Alternatively, the left cover sheet 10 is narrower than the right cover sheet 11. The left and right sides of the second collar 8 are adjustable. In other words, the mounting element 12 may not necessarily be located in the center and can be adjusted leftwards or rightwards.

Figure 10:
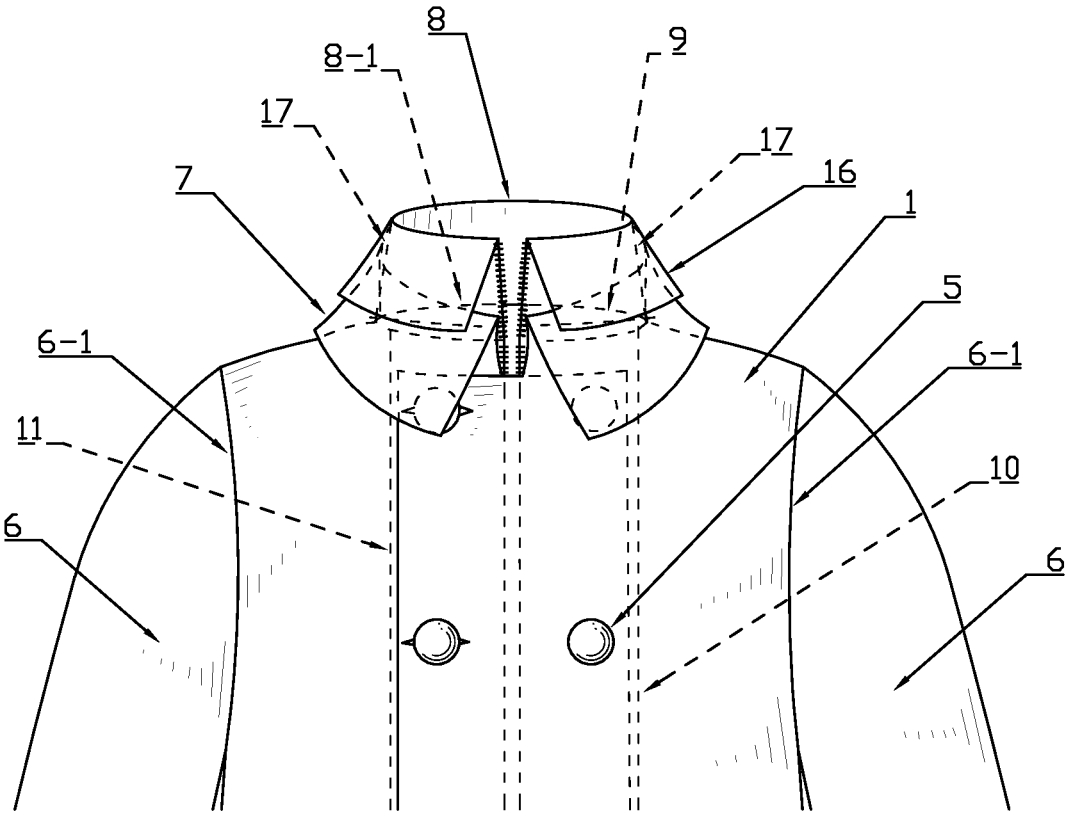
FIG. 10 is a front view of the double breasted raincoat in FIG. 8, showing the reversed folded portion covers the first collar.
Figure 11:
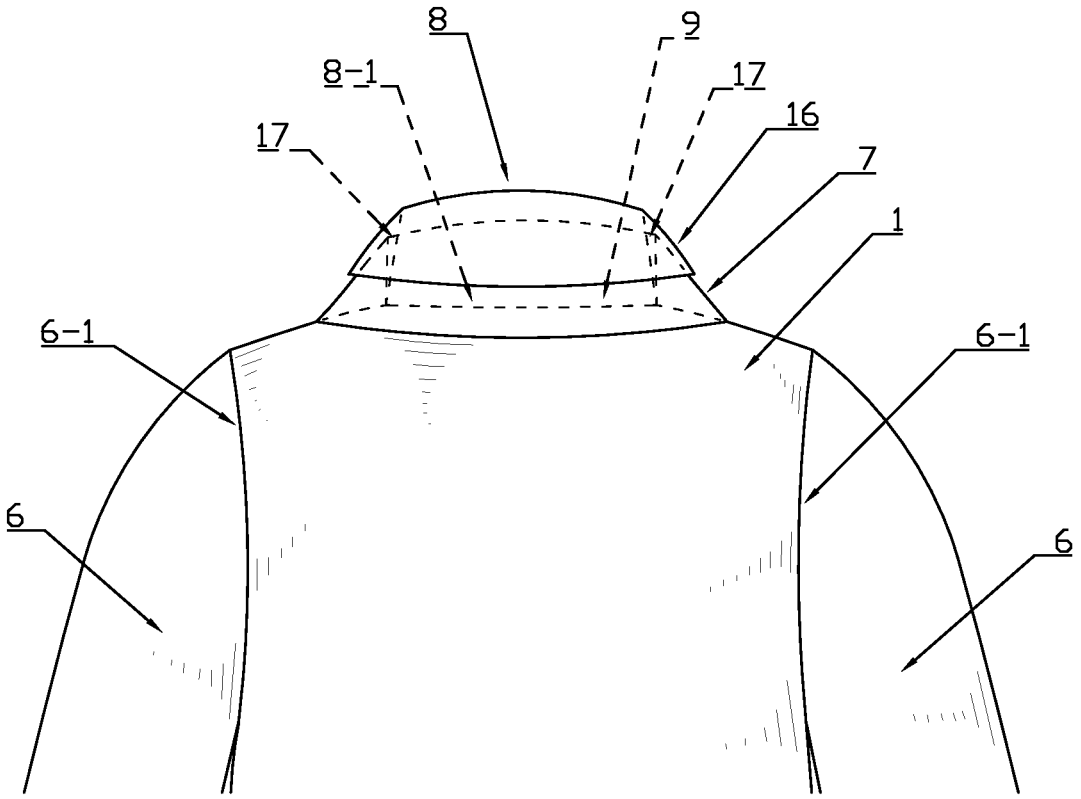
FIG. 11 is a rear view of the double breasted raincoat in FIG. 8.
Figure 12:
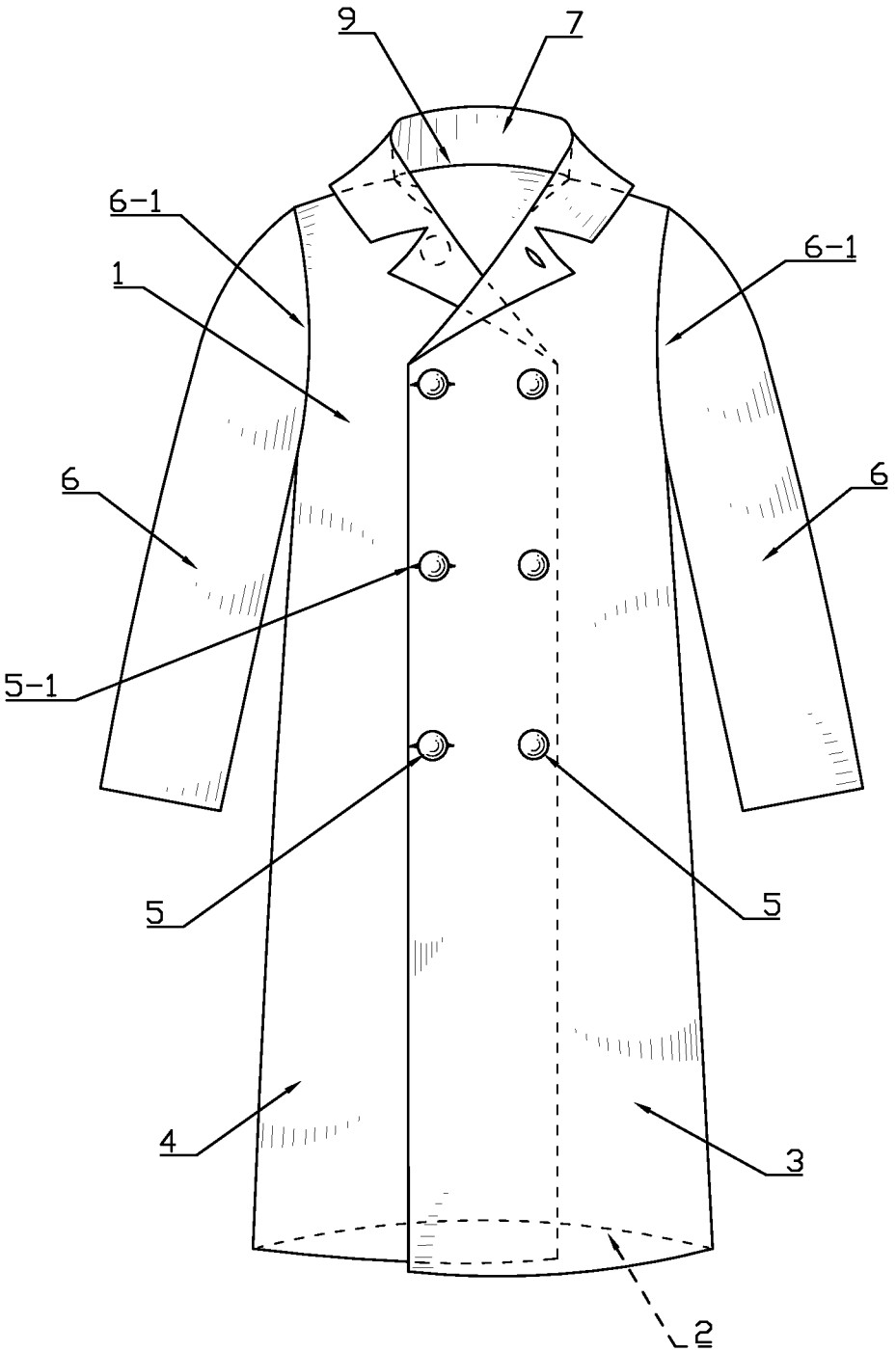
FIG. 12 PRIOR ART
FIG. 12 is a front view of a conventional double breasted raincoat.

With reference to FIG. 8 to FIG. 11, a fourth embodiment of a double breasted raincoat in accordance with the present invention is substantially the same as the first embodiment except for the following features. Wherever there is any sewing seam over the raincoat, a waterproof strip must be pressed on the inner surface of the raincoat. The function of the waterproof strip is to prevent rainwater from penetrating into the raincoat from the sewing seam. Since the neckline 9 needs to be joined to the first collar 7 and the second collar 8 at the same time, when the waterproof strip is provided on the inner surface of the raincoat, the production process becomes complicated. In addition, the lower edge of the first collar 7 and the second collar 8 are fixed to the neckline 9 at the same time, so the first collar 7 and the second collar 8 form a V-shaped gap 17 that may collect water, and therefore the first collar 7 and the lower edge of the second collar 8 also need to be provided with waterproof strips. In order to solve the above problems, the upper edge of the second collar 8 is extended outward to form a reversed folded portion 16. The reversed folded portion 16 is disposed according to the waterproof strip(s), which can greatly increase the efficiency of production and can completely prevent water infiltration. The effect of water prevention in this embodiment is as shown in FIGS. 10 and 11. For example, the first collar 7 may be used to cover the sewing seam of the under edge of the first collar 7 and the neckline 9 so as to prevent the rainwater from contacting the sewing seam and from entering into the raincoat. The reversed folded portion 16 may cover the V-shaped gap 17 between the first collar 7 and the second collar 8 so as to prevent rainwater from flowing into the raincoat through the V-shaped gap 17. The embodiment can achieve the double effect of avoiding the waterproof strip while avoiding the leakage of rainwater.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A double breasted raincoat comprising:

a body having:

a top portion;

a left portion;

a right portion;

a back sheet;

a left front sheet a right front sheet a neckline formed thorough the top portion of the body; and two cuffs respectively formed through the left portion and the right portion of the body, wherein the left front sheet and the right front sheet overlap with each other to form an overlap region, and the overlap region has multiple buttons and button holes;

two sleeves respectively connected with edges of the two cuffs;

a first collar connected with an edge of the neckline;

two cover sheets including:

a left cover sheet disposed on an inner surface of the left front sheet and having:

a left side edge fixed on the inner surface of the left front sheet; and a right cover sheet disposed on an inner surface of the right front sheet and having:

a right side edge fixed on the inner surface of the right front sheet:

a second collar disposed on an inner surface of the first collar, a bottom left side edge of the second collar connected with an upper edge of the left cover sheet, a bottom right side edge of the second collar connected with an upper edge of the right cover sheet, and a lower edge of the second collar connected with an opening edge of the neckline of the body; and at least one mounting element mounted on a right side edge of the left cover sheet and a left side edge of the right cover sheet, wherein the at least one mounting element extends to a left side edge and a right side edge of the second collar.

2. The double breasted raincoat as claimed in claim 1, wherein the left side edge of the left cover sheet is attached on a piece of the left front sheet.

3. The double breasted raincoat as claimed in claim 2, wherein the body has a left shoulder;

a right shoulder;

a left shoulder strap; and a right shoulder strap, wherein an outer side edge of the left shoulder strap and an outer side edge of the right shoulder strap are respectively fixed on the two cuffs, inner sides of the left and right shoulder straps are respectively fixed to the left and right shoulders of the body with fixing buckles, and a left side and a right side of the second collar each have a respective fixing buckle.

4. The double breasted raincoat as claimed in claim 2, wherein the left cover sheet is wider than the right cover sheet, and the second collar is of the same width as the left and right cover sheets.

5. The double breasted raincoat as claimed in claim 2, wherein the right cover sheet is wider than the left cover sheet, and the second collar is of the same width as the left and right cover sheets.

6. The double breasted raincoat as claimed in claim 2, wherein an upper edge of the second collar is extended outward to form a reversed folded portion.

7. The double breasted raincoat as claimed in claim 1, wherein the right side edge of the right cover sheet is attached on a piece of the right front sheet.

8. The double breasted raincoat as claimed in claim 7, wherein the body has a left shoulder;

a right shoulder;

a left shoulder strap; and a right shoulder strap, wherein an outer side edge of the left shoulder strap and an outer side edge of the right shoulder strap are respectively fixed on the two cuffs, inner sides of the left and right shoulder straps are respectively fixed to the left and right shoulders of the body with fixing buckles, and a left side and a right side of the second collar each have a respective fixing buckle.

9. The double breasted raincoat as claimed in claim 7, wherein the left cover sheet is wider than the right cover sheet, and the second collar is of the same width as the left and right cover sheets.

10. The double breasted raincoat as claimed in claim 7, wherein the right cover sheet is wider than the left cover sheet, and the second collar is of the same width as the left and right cover sheets.

11. A double breasted raincoat comprising:

a body having:

a top portion;

a left portion;

a right portion;

a back sheet;

a left front sheet a right front sheet a neckline formed thorough the top portion of the body; and two cuffs respectively formed through the left portion and the right portion of the body, wherein the left front sheet and the right front sheet overlap with each other to form an overlap region, and the overlap region has multiple buttons and button holes;

two sleeves respectively connected with edges of the two cuffs;

a first collar connected with an edge of the neckline;

two cover sheets including:

a left cover sheet disposed on an inner surface of the left front sheet and having:

a left side edge fixed on the inner surface of the left front sheet and a right cover sheet disposed on an inner surface of the right front sheet and having:

a right side edge fixed on the inner surface of the right front sheet;

a second collar disposed on an inner surface of the first collar, a bottom left side edge of the second collar connected with an upper edge of the left cover sheet, a bottom right side edge of the second collar connected with an upper edge of the right cover sheet, and a lower edge of the second collar connected with an opening edge of the neckline of the body; and at least one mounting element mounted on a right side edge of the left cover sheet and a left side edge of the right cover sheet, wherein the body has:

a left shoulder;

a right shoulder;

a left shoulder strap; and a right shoulder strap, wherein an outer side edge of the left shoulder strap and an outer side edge of the right shoulder strap are respectively fixed on the two cuffs, inner sides of the left and right shoulder straps are respectively fixed to the left and right shoulders of the body with fixing buckles, and a left side and a right side of the second collar each have a respective fixing buckle.

12. A double breasted raincoat comprising:

a body having:

a top portion;

a left portion;

a right portion;

a back sheet;

a left front sheet a right front sheet a neckline formed thorough the top portion of the body; and two cuffs respectively formed through the left portion and the right portion of the body, wherein the left front sheet and the right front sheet overlap with each other to form an overlap region, and the overlap region has multiple buttons and button holes;

two sleeves respectively connected with edges of the two cuffs;

a first collar connected with an edge of the neckline;

two cover sheets including:

a left cover sheet disposed on an inner surface of the left front sheet and having:

a left side edge fixed on the inner surface of the left front sheet; and a right cover sheet disposed on an inner surface of the right front sheet and having:

a right side edge fixed on the inner surface of the right front sheet;

a second collar disposed on an inner surface of the first collar, a bottom left side edge of the second collar connected with an upper edge of the left cover sheet, a bottom right side edge of the second collar connected with an upper edge of the right cover sheet, and a lower edge of the second collar connected with an opening edge of the neckline of the body; and at least one mounting element mounted on a right side edge of the left cover sheet and a left side edge of the right cover sheet, wherein the left cover sheet is wider than the right cover sheet, and the second collar is of the same width as the left and right cover sheets.

* * * * *